US007730931B2

(12) United States Patent
Stern

(10) Patent No.: US 7,730,931 B2
(45) Date of Patent: Jun. 8, 2010

(54) METHOD AND APPARATUS FOR PRODUCING PLEATS IN CURTAINS AND PLEATED CURTAINS AND HANGING SAID CURTAINS USING SAID APPARATUS

(76) Inventor: Marilyn Stern, 3426 Prospect St. NW., Washington, DC (US) 20007

( * ) Notice: Subject to any disclaimer, the term of this patent is extended or adjusted under 35 U.S.C. 154(b) by 267 days.

(21) Appl. No.: 11/806,505

(22) Filed: May 31, 2007

(65) Prior Publication Data

US 2008/0295973 A1 Dec. 4, 2008

(51) Int. Cl.
*A47H 13/14* (2006.01)

(52) U.S. Cl. ..... 160/348; 160/330; 16/87.2

(58) Field of Classification Search ..... 160/348, 160/330, 126, 179; 16/87.2, 87.4 R
See application file for complete search history.

(56) References Cited

U.S. PATENT DOCUMENTS 1,307,440 A * 6/1919 Fitch ..... 160/349.1
2,325,056 A * 7/1943 Hess ..... 160/348
2,779,405 A * 1/1957 Hess ..... 160/348
3,369,303 A * 2/1968 Henry ..... 33/563
4,390,055 A * 6/1983 Fenley ..... 160/348
2006/0244254 A1* 11/2006 Repp et al. ..... 283/117

FOREIGN PATENT DOCUMENTS

GB 1420070 * 1/1976

* cited by examiner

*Primary Examiner*—Blair M. Johnson
(74) *Attorney, Agent, or Firm*—Dickstein Shapiro LLP

(57) ABSTRACT

A method and apparatus, for pleating curtains and pleated curtains using the apparatus, are described. The apparatus may be provided as a parts kit which includes a stiffener, pleat-forming members, and fasteners. The stiffener is attached to a curtain and bent into a series of pleat-shaped formations. The pleat-forming members and fasteners are used to hold the stiffener and support the curtain, forming the created pleats in place. The curtain may then be hung on a curtain rod by a separate hanging element which couples the pleat-forming members to a curtain rod. The hanging element may form an integral part of the pleat-forming member.

11 Claims, 4 Drawing Sheets

METHOD AND APPARATUS FOR PRODUCING PLEATS IN CURTAINS AND PLEATED CURTAINS AND HANGING SAID CURTAINS USING SAID APPARATUS

FIELD OF THE INVENTION

The invention is related to curtains and devices for pleating and hanging a curtain.

BACKGROUND OF THE INVENTION

Curtains are a typical means for providing privacy and blocking sunlight, commonly found in the windows of homes, offices, and other buildings. Interior designers and individuals decorating their homes often desire to install or adjust curtain arrangements for aesthetic purposes. A common curtain arrangement is to hang the curtain in such a way as to produce regularly recurring folds, or pleats, in the curtain.

Pleats may be formed in a curtain in a labor-intensive and time-consuming manner that involves sewing folds in the upper edge of the curtain, or stitching various types of pleat curtain headings to the upper edge of the curtain. Alternatively, curtains may be purchased that have pleats professionally pre-sewn in place using special equipment; however, this hampers the flexibility and creativity of the person preparing a custom window treatment to her or his own personal taste by limiting the curtain design to the available selection of pre-sewn curtains. What is needed is a device that will enable application of pleats to non-pleated curtains in a fast and easy manner without requiring professional-level processing or advanced machinery, or further machine or hand sewing.

BRIEF SUMMARY OF THE INVENTION

An apparatus in the form of a curtain pleating kit is disclosed providing a less time-consuming and labor-intensive means for producing pleats in a curtain. A method of using the kit and resulting pleated curtain structures is also disclosed. According to an embodiment of the invention, the location of pairs of openings are marked on the curtain fabric. A template, which may be optionally provided with the kit, can assist in such marking. A flexible stiffener provided in the kit is attached to the curtain. Openings are cut through the stiffener and the curtain fabric. The stiffener can be bent or folded to bring each pair of openings to face one another and a pleat-forming member provided in the kit, for example, a pin, engages each pair of openings. The pleat-forming members are secured in place by fasteners, also provided in the kit, on each end, which hold the stiffener and curtain in a series of recurring pleat-shaped curves. The curtain, having pleats formed therein, may be hung by hooking the pleat-forming member to a curtain rod.

DETAILED DESCRIPTION OF THE INVENTION

In the following detailed description, reference is made to the accompanying drawings which form a part hereof, and in which are shown by way of illustration specific embodiments of the invention. These embodiments are described in sufficient detail to enable those skilled in the art to make and use them, and it is to be understood that structural, logical or procedural changes may be made.

Figure 1:
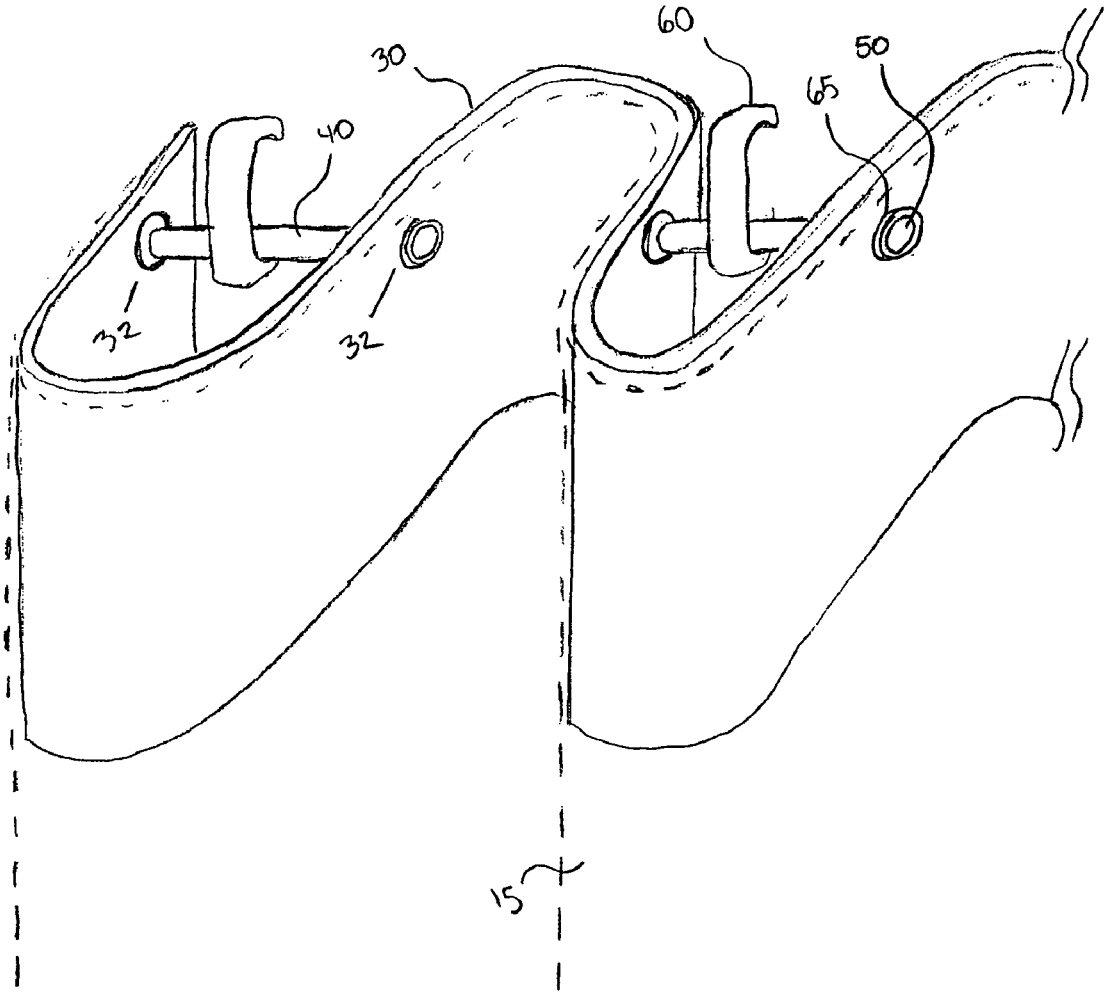
FIG. 1 is a perspective view of an upper edge of a curtain with a stiffener, pleat-forming members and hangers installed according to an embodiment of the invention.
Figure 2A:
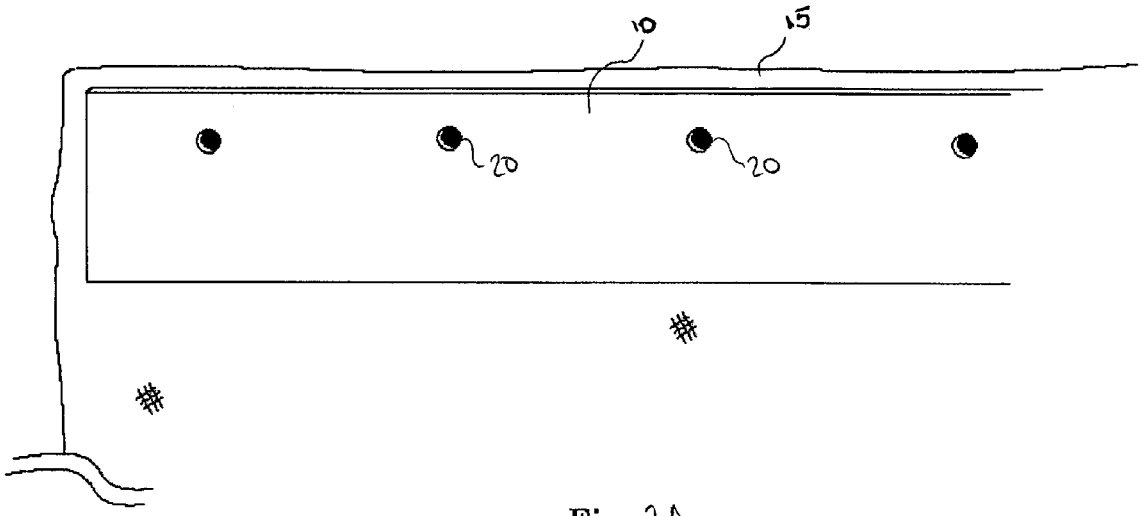
FIG. 2A is a plan view of a template with holes placed over an edge of a curtain which may be used according to an embodiment of the invention.

Referring to FIG. 1, a kit according to an embodiment of the invention includes a stiffener 30, a set of pleat-forming members 40, a set of fasteners 50 and optionally a set of hangers 60 and a template 10 (FIG. 2A). When the stiffener 30, pleat-forming members 40, fasteners 50 and hangers 60 are installed on a curtain 15, as shown in FIG. 1, the curtain 15 is held in a series of pleat-formations and may be hung on a curtain rod.

Figure 2B:
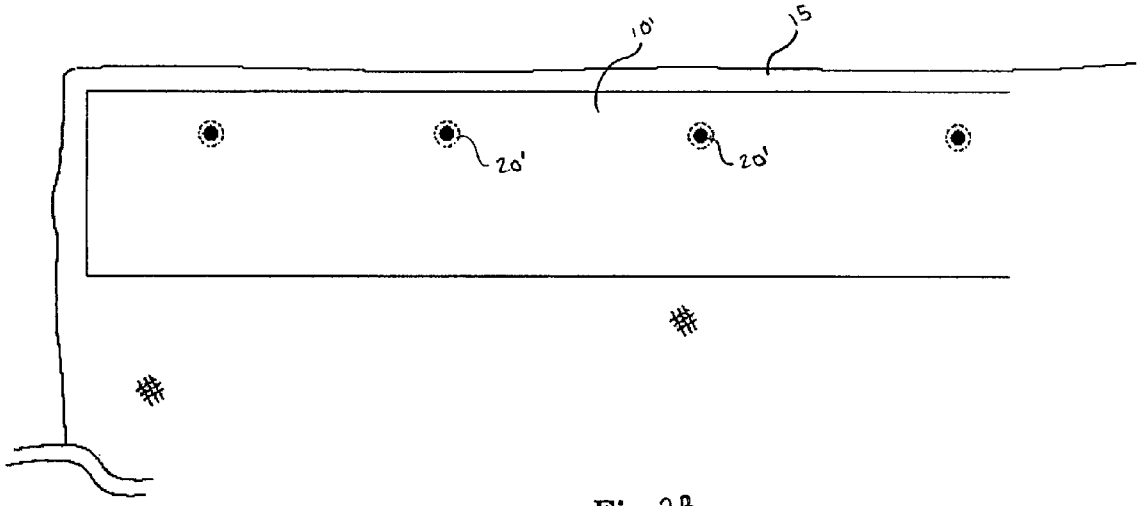
FIG. 2B is a plan view of a template with marking material placed over an edge of a curtain according to an embodiment of the invention.

One or more templates may be provided in the kit to mark the locations of pairs of openings in the stiffener 30 and/or curtain 15 through which pleat-forming members 40 are installed. FIGS. 2A and 2B illustrate embodiments of suitable templates 10, 10'. Templates 10, 10' are illustrated as having a rectangular shape but may be provided in other shapes and are not to be limited to the shape illustrated in the drawings. The templates 10, 10' may include measurement markings or lines (not shown) to aid the user in achieving precise placement of the templates 10, 10' and may be constructed of cloth, cardboard, paper, tissue paper, plastic or any other suitable material. The templates 10, 10' may be provided in various embodiments to facilitate marking the locations of pairs of openings in the curtain 15 and/or the stiffener 30. A variety of templates may be provided in the kit for enabling the creation of different sizes of pleats.

As shown in FIG. 2A, an example template 10 includes openings 20 through which a user may mark the curtain 15 or stiffener 30, for example, using a pen or a marker. After inscribing the marks in the curtain 15 at the locations designated by the placement openings 20, template 10 may be removed and the user may cut openings or punch holes in the curtain 15 and/or stiffener 30 in accordance with the inscribed marks.

FIG. 2B illustrates a second example template 10' according to a second embodiment. Template 10' includes marking substance 20' for marking the curtain 15. For example, in one embodiment marking substance 20' comprises colored wax, which melts upon application of heat. The user employing this embodiment aligns the template 10' on the curtain 15 and applies an iron or similar heating tool to alter marking substance 20' to transfer to the curtain 15 appropriately positioned marks for the pairs of openings in curtain 15.

A stiffener 30 is used to provide the pleat framework and holds the curtain 15 in the desired shape. Preferably, the stiffener 30 is flexible to allow easy attachment to a curtain and bending to form the pleats. Any number of suitable materials having a sturdy but flexible constitution may be used for construction of the stiffener 30, including but not limited to cardboard, plastic, buckram, or stiff, woven or non-woven fusible or non-fusible fabric. The stiffener 30 should be attached to a hanging side of a curtain 15, as shown in FIG. 1. The stiffener 30 may be attached in various ways, for example but not limited to, sewing, gluing, fusing by heat application or stapling. The stiffener 30 may include openings which are in accord with the markings 20, 20' of the template 10, 10', or the stiffener 30 may be constructed of a material through which the user may easily create openings.

In one embodiment, the template 10, 10' and stiffener 30 may be combined into a single element which may be included in the kit and attached to the curtain 15, having openings or indicators of proposed opening placements included therein.

After the stiffener 30 having openings which are aligned with openings cut into the curtain 15 is installed, the stiffener 30 is bent into a series of pleat-shaped or S-shaped formations by bringing each opening to face an opposing opening such that opposite ends of each pleat-forming member 40 may be inserted into an associated pair of openings 32. FIGS. 1 and 3A-3C show the pleat-forming members 40 as pins having ends which engage the holes in the stiffener 30 and curtain 15. A fastener 50 is attached to the ends of the pins 40, thereby securing the stiffener 30 and the curtain 15 in the series of pleat-shaped formations, as shown in FIG. 1.

FIGS. 3A-3E show example embodiments of pin-type pleat-forming members 40*a*-40*e* and fasteners 50*a*-50*e* for engaging with the pleat-forming members 40*a*-40*e*. It should be understood that the invention is not limited to the pleat-forming member/fastener combinations illustrated and that the invention encompasses any and all equivalent devices capable of securing the stiffener 30 in pleat-shaped formations and providing a support base from which the curtain 15 may be hung. Each fastener embodiment includes washers and/or supportive bases. The fasteners function by pressing a washer tightly against another washer or a supportive base, compressing the curtain 15 in between and thereby distributing the force (due to the weight of the curtain) that is applied to the opening in the curtain over a greater area. This helps prevent the curtain 15 from tearing around the openings 32 (FIG. 1) when hung.

Figure 3A:
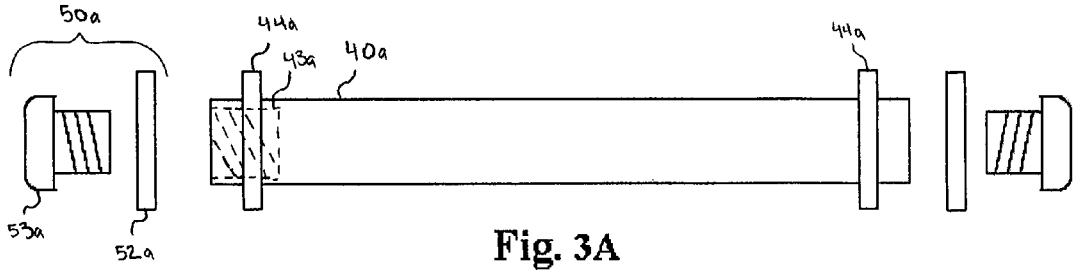
FIG. 3A is a pleat-forming member with washer-screw fasteners according to an embodiment of the invention.

FIG. 3A shows a pleat-forming member 40*a* having opposed supportive bases 44*a* and a threaded hole 43*a* for receiving a screw 53*a* and washer 52*a* (collectively fastener 50*a*) which may be used to secure the stiffener 30 and curtain 15 to the end of the pleat-forming member 40*a* such that the stiffener 30 and curtain 15 are prevented from expanding back to a flat position, thus preserving the pleats in the curtain 15. The stiffener 30 and curtain 15 material is compressed between washer 52 and the supportive base 44*a*.

Figure 3B:
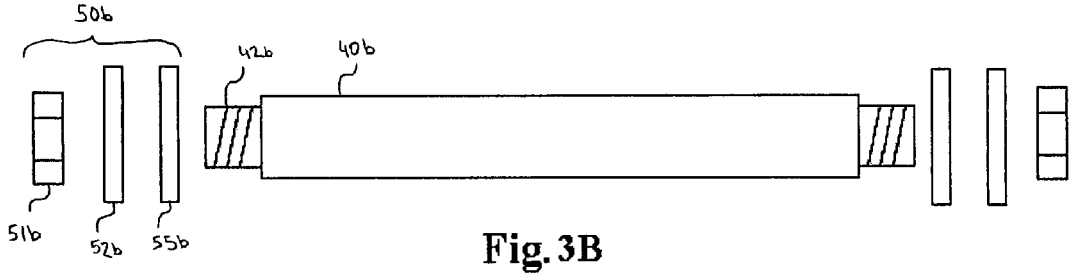
FIG. 3B is a pleat-forming member with washer-nut fasteners according to an embodiment of the invention.

FIG. 3B shows a pleat-forming member 40*b* having threaded ends 42*b* for receiving and attaching to washers 52*b*, 55*b* and nut 51*b* (collectively fastener 50*b*) which may be used to secure the end of the pleat-forming member 40*b*. The stiffener 30 and curtain 15 material is compressed between washers 52*b*, 55*b*.

Figure 3C:
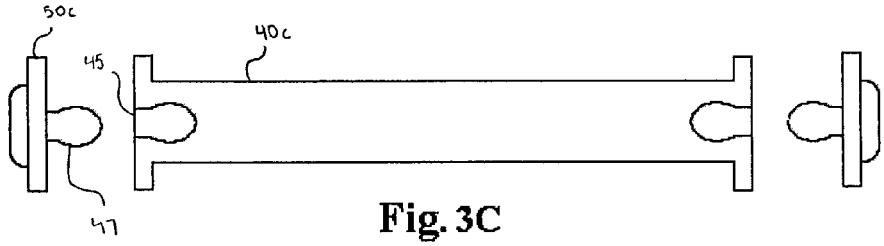
FIG. 3C is a pleat-forming member with pop-in bead fasteners according to an embodiment of the invention.

FIG. 3C shows a pleat-forming member 40*c* having an accompanying pop-in bead fastener 50*c*. The pop-in bead fastener 50*c* includes a projection 47 that fits within an opening 45 in the pleat-forming member 40*c*. This embodiment may be easily constructed of plastic and facilitate a quick installation of the pleat-producing kit.

Figure 3D:
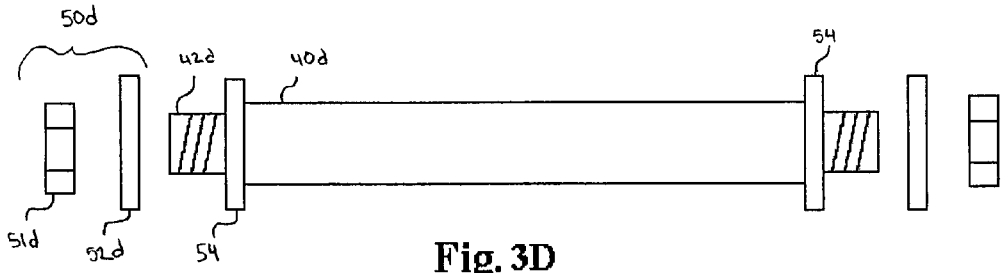
FIG. 3D is another pleat-forming member with washer-nut fasteners according to an embodiment of the invention.

FIG. 3D shows a pleat-forming member 40*d* having attached supportive bases 54. An appropriate fastener 50*d* for member 40*d* could include a nut 51*d* and a washer 52*d*. This embodiment functions similar to the embodiment illustrated in FIG. 3B.

Figure 3E:
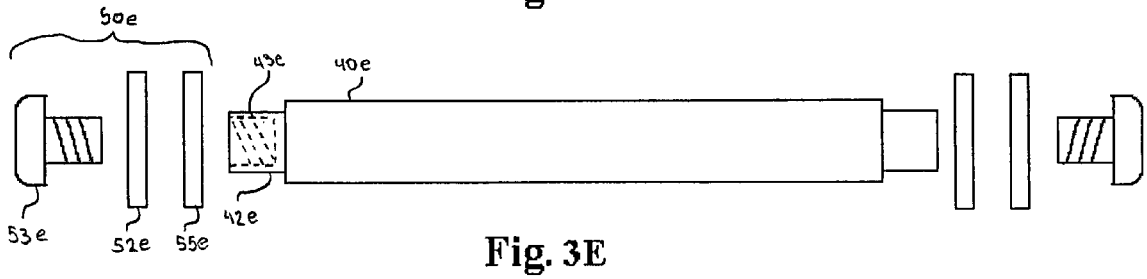
FIG. 3E is another pleat-forming member with washer-screw fasteners according to an embodiment of the invention.

FIG. 3E shows a pleat-forming member 40*e* having non-threaded ends 42*e* that include a threaded hole 43*e*. The illustrated fastener 50*e* includes a screw 53*e* and two washers 52*e*, 55*e* for securing the pleat-forming member 40*e* to the curtain 15 and stiffener 30. Any of the above described pleat-forming members 40*a*-40*e* may be provided having adjustable length members to allow for creating pleats of different sizes.

The kit according to the invention may optionally include grommets 65 (FIG. 1) for insertion within the openings 32 (FIG. 1) for bolstering the same, and also optionally may include a standard device for installing the grommets (not shown). The use of grommets 65 would provide an alternative supportive frame for the openings in the curtain 15, decreasing the risk of unwanted tears forming in the curtain 15 around the holes. A kit that includes grommets 65 could include a pleat-forming member 40' and fastener 50' as shown in FIG. 3B, omitting washers 52, 55.

Referring back to FIG. 1, pleat-forming members 40 in the form of pins are shown installed, providing support segments from which the curtain 15 may be hung. Hanging devices 60 are used to hang the curtain 15 from a curtain rod (FIG. 4C) and may be optionally provided in the parts kit. The hanging devices 60 are illustrated as C-shaped rings for convenience only, hanging devices 60 of different shapes may be used, including but not limited to S-shaped hooks, J-shaped hooks, linked-rings, single rings, rope/wire loops or the like.

Figure 4A:
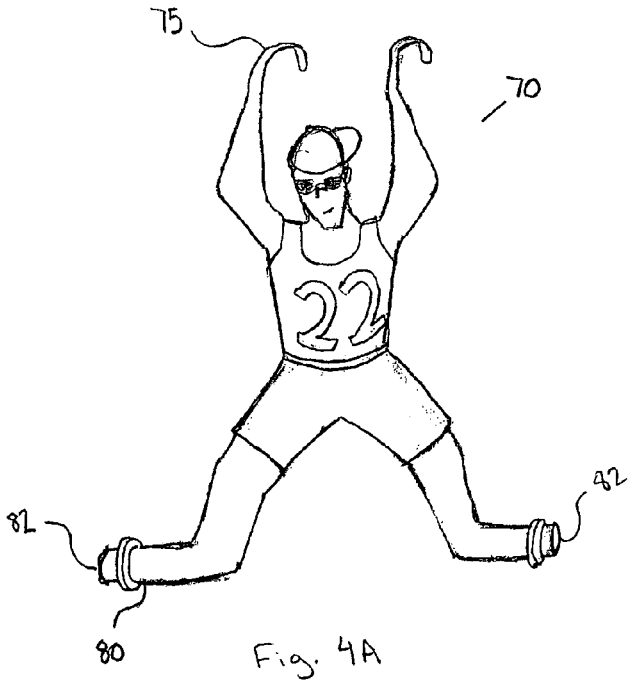
FIG. 4A is an example of a decorative pleat-forming member having an integral hooking element according to an embodiment of the invention.
Figure 4B:
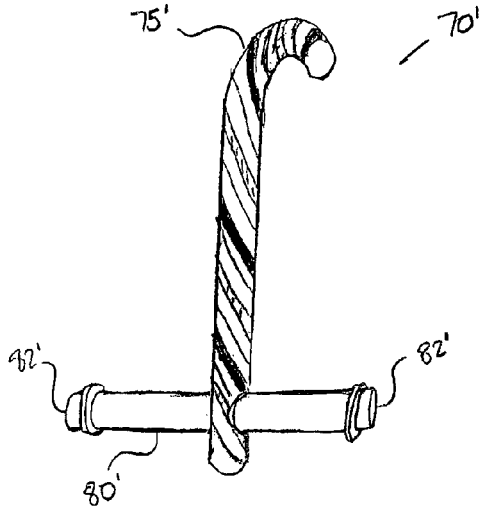
FIG. 4B is a second example of a decorative pleat-forming member having an integral hooking element according to an embodiment of the invention.
Figure 4C:
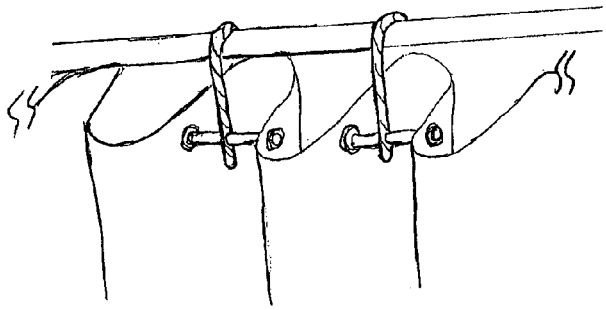
FIG. 4C is a perspective view of a decorative pleat-forming member installed in a curtain.

Hanging device 60 and a pleat-forming member 40 may be combined into a single element. FIGS. 4A and 4B each show a decorative embodiment of a combined hook/pleat-forming member 70, 70'. FIG. 4A shows a figure of a basketball player, for example, suitable for use in hanging a curtain in a child's room. FIG. 4B shows an candy-cane figure, for example, suitable for use during Christmas holiday seasons. Other decorative embodiments may be used. The combined hook/pleat-forming member 70, 70' includes a hanging section 75, 75' for hanging the curtain 15 from a rod and a pleat-forming section 80, 80' having opposed ends 82, 82' for passing through holes in the stiffener 30 and curtain 15, as shown in FIG. 4C. Hooking section 75, 75' is illustrated as a hook-shaped element, but may be constructed as any of the hanging devices 60 described above or in any equivalent manner. Pleat-forming section 80, 80' may be constructed in accordance with the above description of pleat-forming members 40*a*-40*e* and may use fasteners 50*a*-50*e* or any other suitable structure for fastening the pleat-forming section 40 to the stiffener/curtain openings.

For example, if the pleat-forming section of the combined hook/pleat-forming section 70, 70' were equivalent to the pleat-forming member 40 and fastener 50 combination, then washer 55 would allow additional compression of the pleats and prevent the pleats from expanding along the pleat-forming section 70, 70' axis of the combined hook/pleat-forming section 70, 70'. Washer 52 and nut 51 would be used in combination to secure the stiffener 30 and curtain 15 to the end of pleat-forming sections 80, 80' so that the stiffener 30 and curtains 15 are prevented from expanding back to a flat position, thus preserving the pleats in the curtain 15. Similarly, if the combined hook/pleat-forming section 70, 70' were equivalent to the pleat-forming member 40' and fastener 50', or to 40" and 50", then their function and structure would be as discussed previously for these respective pleat-forming member/fastener combinations.

While embodiments have been described in detail, it should be readily understood that embodiments of the invention are not limited to the disclosed embodiments. Rather the embodiments can be modified to incorporate any number of variations, alterations, substitutions or equivalent arrangements not heretofore described.

What is claimed as new and desired to be protected by Letters Patent of the United States is:

1. A method of producing pleats in a material, comprising:

designating locations for openings on the curtain in a material;

creating openings through said material according to said designated locations;

folding the material into pleat shapes;

attaching pleat-forming members to adjacent pairs of openings in the folded material, each pleat-forming member having an axis and an associated first pressing element and a first fastening portion at respective opposite ends thereof; and;

the first fastening portion being integrally formed on each respective end of the pleat forming member;

securing the ends of the pleat-forming members to the folded material with fasteners such that the pleat-forming members hold the material in a series of pleat-shaped formations, the material being substantially orthogonal to the axis where the pleat forming members as secured to the material, each said fastener having an associated second fastening portion for engaging with a respective one of the first fastening portions of one of the pleat-forming members, and an associated second pressing element for cooperating with a respective first pressing element to hold the material between them in areas surrounding said openings; and inserting at least one of said first and second fastening portions into said openings prior to securing the ends of the pleat-forming member to said material.

2. The method of claim 1, wherein the pleat-forming members include an integral hanger element, the method further comprising hanging the curtain on a material rod by the hanger element.

3. The method of claim 1, wherein the locations are designated using a template having openings through which the material may be marked.

4. The method of claim 1, further comprising providing a stiffener at an edge of said material wherein said stiffener includes marks designating locations for creating openings in the material and the stiffener.

5. The method of claim 1, wherein the locations are designated using a template comprising a pattern on tissue paper.

6. The method of claim 1, further comprising:

placing a template over a section of the material; and transferring a marking material on the template onto the material.

7. The method of claim 6, wherein the marking material is transferable through the application of heat to the marking material, said method further comprising transferring the marking material onto the material through the application of heat.

8. The method of claim 1, wherein said pleat-forming members are pins.

9. The method of claim 1, wherein said first pressing elements are integrally formed at ends of each pleat-forming member.

10. The method of claim 1, wherein the first fastening portions comprise internal screw threads and the second fastening portions comprise screws engageable with the internal screw threads.

11. The method of claim 1, wherein the first fastening portions each comprise a receiving opening and the second fastening portions each comprise a pop-in bead engaging with a receiving opening.

* * * * *